US011877681B2

(12) United States Patent
Willhoit et al.

(10) Patent No.: US 11,877,681 B2
(45) Date of Patent: Jan. 23, 2024

(54) DOORMAT

(71) Applicants: Spencer Willhoit, Bonsall, CA (US); Liam O'Brien, Seattle, WA (US)

(72) Inventors: Spencer Willhoit, Bonsall, CA (US); Liam O'Brien, Seattle, WA (US)

(73) Assignee: Spencer Willhoit, Bonsall, CA (US)

( * ) Notice: Subject to any disclaimer, the term of this patent is extended or adjusted under 35 U.S.C. 154(b) by 168 days.

(21) Appl. No.: 17/668,983

(22) Filed: Feb. 10, 2022

(65) Prior Publication Data

US 2022/0248888 A1 Aug. 11, 2022

Related U.S. Application Data

(60) Provisional application No. 63/148,577, filed on Feb. 11, 2021.

(51) Int. Cl.
*A47G 29/20* (2006.01)
*A47L 23/26* (2006.01)

(52) U.S. Cl.
CPC ..... *A47G 29/20* (2013.01); *A47L 23/266* (2013.01)

(58) Field of Classification Search
CPC ..... A47G 29/20; A47G 29/22; A47G 29/141; A47G 2029/144; A47L 23/266; A47L 23/26; B65D 7/26; B65D 9/14; B65D 15/24; B65D 21/086
USPC ..... 232/19
See application file for complete search history.

(56) References Cited

U.S. PATENT DOCUMENTS

| | | | | |
|---|---|---|---|---|
| 10,786,104 | B1 * | 9/2020 | Pappas | A47L 23/266 |
| 11,492,172 | B1 * | 11/2022 | Izquierdo | A47G 29/141 |
| 2001/0040422 | A1 * | 11/2001 | Gramlich | G07F 17/13 340/532 |
| 2016/0068306 | A1 * | 3/2016 | Heinz | A47G 29/141 220/6 |
| 2020/0390313 | A1 * | 12/2020 | Pappas | H04N 7/185 |
| 2022/0151420 | A1 * | 5/2022 | Pappas | B60W 60/001 |
| 2023/0081315 | A1 * | 3/2023 | Sebro | A47G 29/141 232/38 |

* cited by examiner

*Primary Examiner* — William L Miller
(74) *Attorney, Agent, or Firm* — CP LAW GROUP PC; Cy Bates

(57) ABSTRACT

The disclosure concerns an improved doormat having an anchored frame surrounding a center portion. A collapsible storage apparatus is rotatably coupled to the anchored frame and is configured to deploy into an expanded state and retract into a collapsed state. The collapsible storage apparatus is configured to store and secure delivered packages. In some embodiments, the center portion includes a doormat material disposed on an upper surface thereof. In some embodiments, the collapsible storage apparatus is disposed between the center portion and the anchored frame while in a collapsed state.

18 Claims, 8 Drawing Sheets

DOORMAT

CROSS-REFERENCE TO RELATED APPLICATIONS

This application claims benefit of priority with U.S. Provisional Application Ser. No. 63/148,577, filed Feb. 11, 2021; the entire contents of which are hereby incorporated by reference.

BACKGROUND

Field of the Invention

This invention relates to an improved doormat; more particularly, an improved doormat comprising a collapsible storage apparatus.

Description of the Related Art

E-commerce has significantly grown over the past decade and with such growth has brought an increase to home deliveries. Many packages are delivered at the front of an occupant's door, and many are not retrieved by the occupant until later in the day. An unfortunate result of increased home deliveries is that thefts for packages have increased to the point that the perpetrators have been unofficially been given a title of "porch pirate".

There are many solutions in the public domain attempting to solve this problem. Some use a combination of alarms and cameras to deter theft. However, this provides no physical deterrent and given the ease and short time required to grab a package and subsequently escape, alarms and cameras alone are an insufficient solution.

Many solutions include using a box or container which is capable of locking once the package is placed inside. Although this solution may be effective for preventing theft, many of the containers are too large to fit in the space available in front of the door. Additionally, the containers are constantly in view and may considered to be unsightly.

There is a need for a convenient way of protecting package deliveries from theft and damage without requiring a large and unsightly container.

SUMMARY

The disclosure concerns an improved doormat having an anchored frame surrounding a center portion. A collapsible storage apparatus is rotatably coupled to the anchored frame and is configured to deploy into an expanded state and retract into a collapsed state. The collapsible storage apparatus is configured to store and secure delivered packages.

In some embodiments, the center portion comprises a doormat material disposed on an upper surface thereof. In some embodiments, the collapsible storage apparatus is disposed between the center portion and the anchored frame while in a collapsed state.

BRIEF DESCRIPTION OF THE DRAWINGS

Other features, combinations, and embodiments will be appreciated by one having the ordinary level of skill in the art upon a thorough review of the following details and descriptions, particularly when reviewed in conjunction with the drawings, wherein.

DETAILED DESCRIPTION

Figure 1:
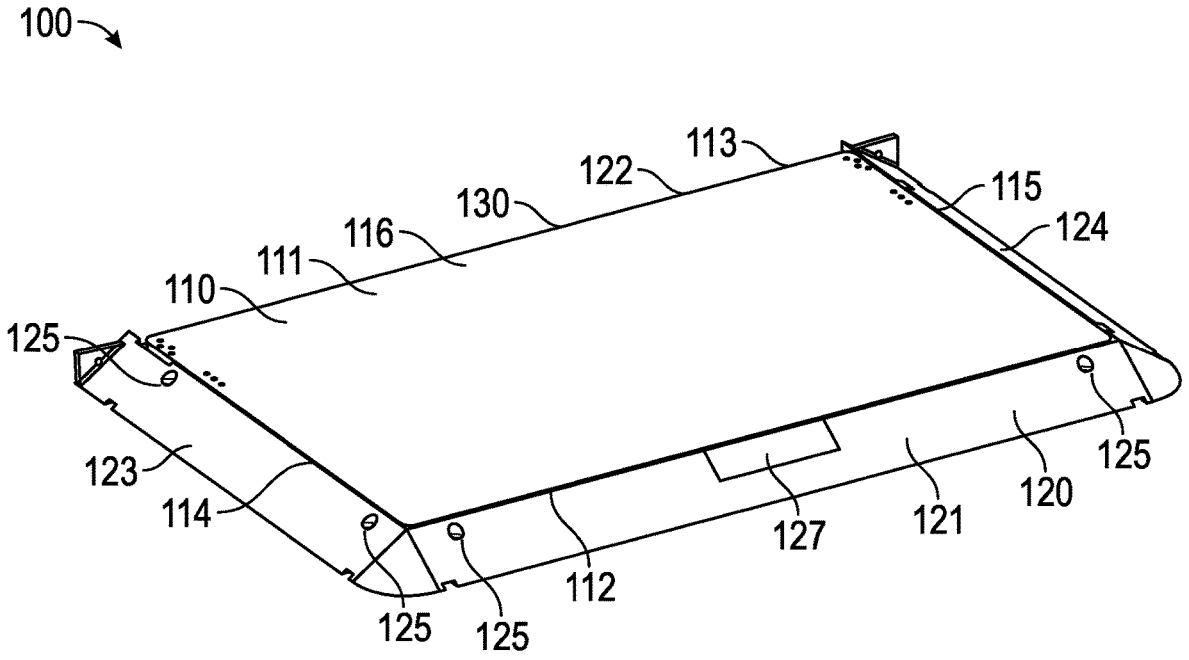
FIG. 1 shows a perspective view of an improved doormat in accordance with a first illustrated embodiment.

For purposes of explanation and not limitation, details and descriptions of certain preferred embodiments are hereinafter provided such that one having ordinary skill in the art may be enabled to make and use the invention. These details and descriptions are representative only of certain preferred embodiments, however, a myriad of other embodiments which will not be expressly described will be readily understood by one having skill in the art upon a thorough review of the instant disclosure. Accordingly, any reviewer of the instant disclosure should interpret the scope of the invention only by the claims, as such scope is not intended to be limited by the embodiments described and illustrated herein.

Unless explicitly defined herein, terms are to be construed in accordance with the plain and ordinary meaning as would be appreciated by one having skill in the art.

General Description of Embodiments

In one embodiment, an improved doormat is disclosed. The improved doormat comprises an anchored frame anchored to a ground surface, the anchored frame comprising a plurality of sides and a latch disposed on at least one of the plurality of sides, a center portion disposed within the anchored frame, the center portion having an upper surface and a lower surface opposite the upper surface, the center portion further comprising a coupler element configured to couple to the latch when the improved doormat is in a collapsed state, and a collapsible storage apparatus rotatably coupled to the anchored frame, the collapsible storage apparatus being disposed between the anchored frame and the center portion. The collapsible storage apparatus comprises the center portion rotatably coupled to the anchored frame, a front portion opposite the center portion, a first collapsible side coupled to the lower surface of the center portion and further coupled to the front portion, a second collapsible side coupled to the lower surface of the center portion and further coupled to the front portion, and a lid rotatably coupled to the front portion. The upper surface of the center portion comprises a doormat material.

In some embodiments, the improved doormat may further comprise a plurality of gas springs, wherein each of the plurality of gas springs is coupled to the anchored frame and further coupled to the lower surface of the center portion.

In a second embodiment, an improved doormat is disclosed. The improved doormat comprises an anchored frame anchored to a ground surface, the anchored frame comprising a plurality of sides, a center portion disposed within the anchored frame, the center portion having an upper surface and a lower surface opposite the upper surface, and a collapsible storage apparatus rotatably coupled to the anchored frame, wherein the collapsible storage apparatus is disposed between the anchored frame and the center portion.

In some embodiments, the upper surface may further comprise a doormat material.

In some embodiments, the improved doormat may further comprise a plurality of gas springs, wherein each of the plurality of gas springs is coupled to the anchored frame and further coupled to the lower surface of the center portion.

In some embodiments, the anchored frame may further comprise a latch. IN some embodiments, the center portion may further comprise a coupler element configured to couple to the latch when the improved doormat is in a collapsed state.

In some embodiments, the collapsible storage apparatus may comprise the center portion rotatably coupled to the anchored frame, a front portion opposite the center portion, a first collapsible side coupled to the lower surface of the center portion and further coupled to the front portion, a second collapsible side coupled to the lower surface of the center portion and further coupled to the front portion, and a lid rotatably coupled to the front portion.

In some embodiments, the center portion may further comprise a coupler element and the lid may further comprise an aperture such that the coupler element is configured to be inserted through the aperture.

In some embodiments, the collapsible storage apparatus may comprise a terminal end rotatably coupled to the anchored frame and a canopy frame coupled to the anchored frame and further coupled to the terminal end. In some embodiments, the canopy frame includes a canopy and one or more ribs. In some embodiments, the terminal end is rotatably coupled to the anchored frame at a first major side. The terminal end may be further coupled to the anchored frame at a second major side.

In a third embodiment an improved doormat is disclosed. The improved doormat comprises an anchored frame anchored to a ground surface, the anchored frame comprising a plurality of sides, a center portion disposed within the anchored frame, the center portion having an upper surface and a lower surface opposite the upper surface, and a collapsible storage apparatus rotatably coupled to the anchored frame. The upper surface comprises a doormat material.

In some embodiments, the collapsible storage apparatus may be disposed between the anchored frame and the center portion.

In some embodiments, the improved doormat may further comprise a plurality of gas springs, wherein each of the plurality of gas springs is coupled to the anchored frame and further coupled to the lower surface of the center portion.

In some embodiments, the anchored frame may further comprise a latch. IN some embodiments, the center portion may further comprise a coupler element configured to couple to the latch when the improved doormat is in a collapsed state.

In some embodiments, the collapsible storage apparatus may comprise the center portion rotatably coupled to the anchored frame, a front portion opposite the center portion, a first collapsible side coupled to the lower surface of the center portion and further coupled to the front portion, a second collapsible side coupled to the lower surface of the center portion and further coupled to the front portion, and a lid rotatably coupled to the front portion.

In some embodiments, the center portion may further comprise a coupler element and the lid may further comprise an aperture such that the coupler element is configured to be inserted through the aperture.

In some embodiments, the collapsible storage apparatus may comprise a terminal end rotatably coupled to the anchored frame and a canopy frame coupled to the anchored frame and further coupled to the terminal end. In some embodiments, the canopy frame includes a canopy and one or more ribs . . . . In some embodiments, the terminal end is rotatably coupled to the anchored frame at a first major side. The terminal end may be further coupled to the anchored frame at a second major side.

Manufacturing

The doormat material may comprise a material that is conventionally used for doormats, including polyvinyl chloride, coir, rubber, polypropylene, polyester, cotton, cloth, fabric, palmyra, fiber, nylon, or a combination thereof. Other durable materials may also be utilized.

The collapsible storage apparatus may be manufacture from materials such as various kinds of metals and plastics. Examples of plastics include polypropylene, polyethylene, and polycarbonate. The canopy may comprise material which is resistant to cutting, tearing, water or sun, and any combination thereof. Examples can nylon fabric, polyester, polyvinyl chloride, or any other material known to one having skill in the art which has the preferable flexibility and durability for the package cover apparatus.

Each of the components of the improved doormat and described herein may be manufactured and/or assembled in accordance with the conventional knowledge and level of a person having skill in the art.

While various details, features, combinations are described in the illustrated embodiments, one having skill in the art will appreciate a myriad of possible alternative combinations and arrangements of the features disclosed herein. As such, the descriptions are intended to be enabling only, and non-limiting. Instead, the spirit and scope of the invention is set forth in the appended claims.

First Illustrated Embodiment

Now turning to the drawings, FIG. 1 shows a perspective view of an improved doormat (100) in a collapsed state in accordance with a first illustrated embodiment. The improved doormat comprises a center portion (110) surrounded by an anchored frame (120). The center portion comprises a first major edge (112), a second major edge (113), a first minor edge (114), and a second minor edge (115). The center portion further comprises an upper surface (116) comprising a doormat material (111). The anchored frame comprises a first major side (121) adjacent to the first major edge, a second major side (122) adjacent to the second major edge, a first minor side (123) adjacent to the first minor edge, and a second minor side (124) adjacent to the second minor edge.

The center portion (110) is rotatably coupled to the anchored frame (120) at a hinge (130) disposed at the second major side (122). The center portion disengages from a latch (127) at the first major side (121) and rotates about the second major side. Disposed at corners of the anchored frame are anchor points (125) for providing anchoring to a ground surface.

Figure 2:
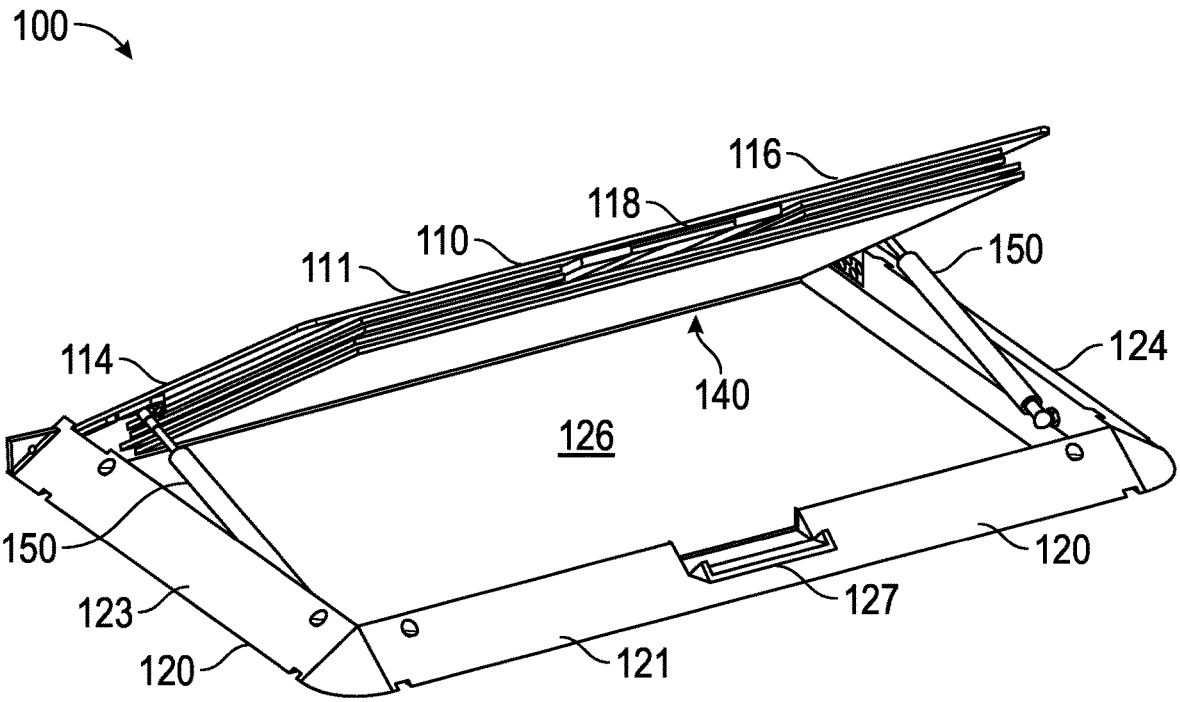
FIG. 2 shows an alternative perspective view of the improved doormat in accordance with the first illustrated embodiment.

FIG. 2 shows an alternative perspective view of the improved doormat (100) in a partially expanded state in accordance with the first illustrated embodiment. The improved doormat comprises an anchored frame (120) and a center portion (110) rotatably coupled to the anchored frame. The center portion comprises a doormat material (111) disposed on an upper surface (116) of the center portion. A collapsible storage apparatus (140) is shown in a collapsed state as the improved doormat (100) is being deployed into an expanded state. The anchored frame comprises a first major side (121), a first minor side (123), and a second minor side (124). The anchored frame further comprises a bottom portion (126) coupled to each of the first major side, second major side, first minor side and second minor side. While the improved doormat is in a fully collapsed state, the collapsible storage apparatus is disposed between the center portion and the anchored frame, namely the doormat material of the center portion and the bottom portion of the anchored frame.

The center portion (110) further comprises a coupler element (118) configured to engage with a latch (127) disposed on the first major side (121) of the anchored frame (120). When the latch is disengaged from the coupler element, the center portion is configured to rotate upwards with assistance of springs (150), such as gas springs or the like. The gas springs can be configured to lift the center portion by themselves, or can be configured to assist a user from raising the center portion by providing an upward force when deploying into the expanded state, and further configured to provide a dampening force when retracting into a collapsed state.

Figure 3:
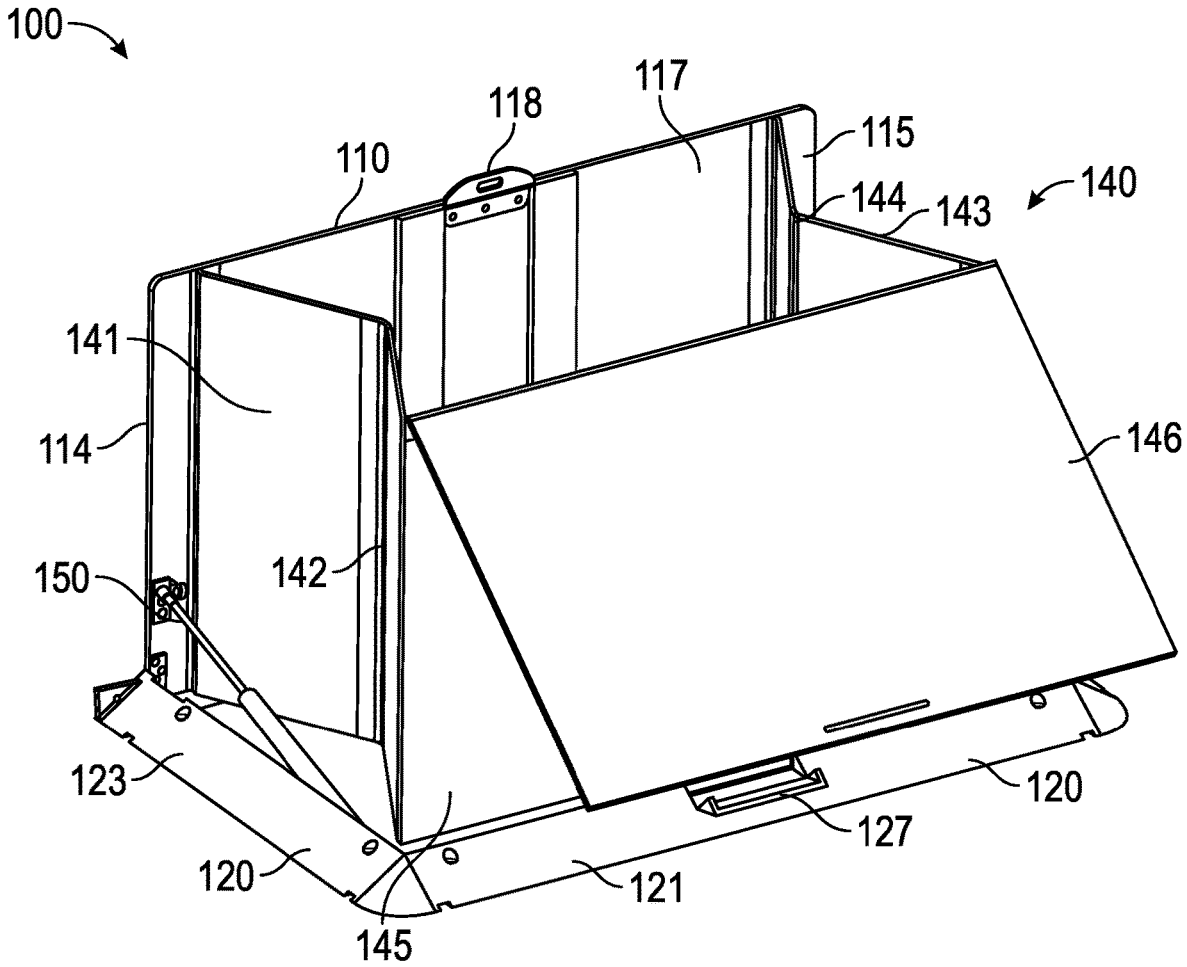
FIG. 3 shows a perspective view of the improved doormat in an expanded configuration in accordance with the first illustrated embodiment.

FIG. 3 shows a perspective view of the improved doormat (100) in an expanded configuration in accordance with the first illustrated embodiment. The improved doormat comprises an anchored frame (120), a center portion (110), and a collapsible storage apparatus (140). The collapsible storage apparatus comprises four sides and a lid (146). The four sides comprise the center portion, a front portion (145) opposite the center portion, a first collapsible side (141), and a second collapsible side (143) opposite the first collapsible side. The first collapsible side comprises a first side hinge (142) disposed at a middle portion thereof. The second collapsible side comprises a second side hinge (144) disposed at a middle portion thereof. The first and second collapsible sides are hingedly coupled to a lower surface (117) of the center portion and further hingedly coupled to the front portion. Hinges may comprise a living hinge or other mechanical equivalent to achieve the collapsing function.

The lid (146) is rotatably coupled to the front portion (145) and is configured to couple with the center portion (110) at a coupler element (118) disposed on the center portion. In one embodiment, the lid comprises an aperture configured to receive the coupler element wherein upon the apparatus engaging with the coupler element, a locking device can be used to lock the collapsible storage apparatus (140). While in a locked state, the collapsible storage apparatus cannot retract down into a collapse state due to the rigidity of the lid preventing the front portion from moving closer to the center portion, which thereby prevents the first collapsible side (141) and second collapsible side (143) from collapsing.

One or more springs (150) are shown coupled to the lower surface (117) of the center portion and further coupled to the anchored frame (120). The springs may include gas springs or the like, and are configured to assist with deploying and retracting the collapsible storage apparatus (140).

Figure 4:
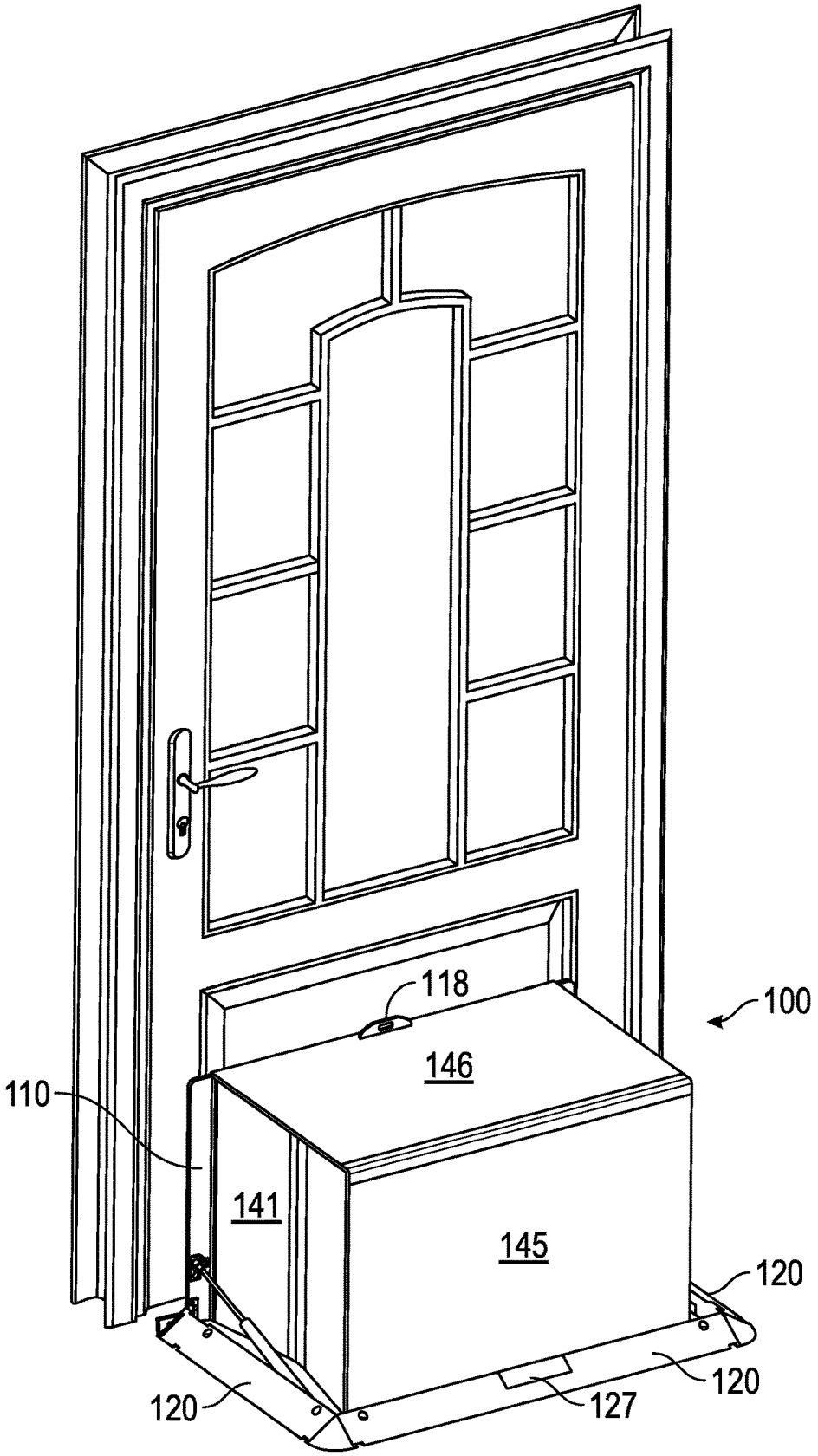
FIG. 4 shows an alternative perspective view of the improved doormat in an expanded configuration in accordance with the first illustrated embodiment.

FIG. 4 shows an alternative perspective view of the improved doormat (100) in an expanded configuration in accordance with the first illustrated embodiment. The improved doormat comprises an anchored frame (120) having a collapsible storage apparatus (140) disposed within the anchored frame. The collapsible storage apparatus comprises a center portion (110) opposite the front portion (145), a first collapsible side (141), and a second collapsible side (not shown). A lid is disposed on top of the center portion, the front portion, and the first and second collapsible sides. The improved doormat is shown in an expanded state in front of a doorway. While in the expanded state, the improved doormat can store and protect delivered packages. A locking mechanism can be used to keep the collapsible storage apparatus in a locked state to prevent theft of packages contained therein.

Once packages are retrieved from inside the collapsible storage apparatus (140), the improved doormat (100) can be collapsed back down into a collapsed state. Steps of collapsing the collapsible storage apparatus may include lifting the lid (146) and rotating the lid until the lid is parallel with and tangent to the front portion (145). The first and second collapsible sides (141; 143) and then pushed inward, causing the front portion and lid to retract closer to the center portion (110). When the lid, front portion, and first and second collapsible sides are fully collapsed together, the center portion can then be rotatably closed until a coupler element (118) engages with a latch on the anchored frame (120).

Second Illustrated Embodiment

Figure 5:
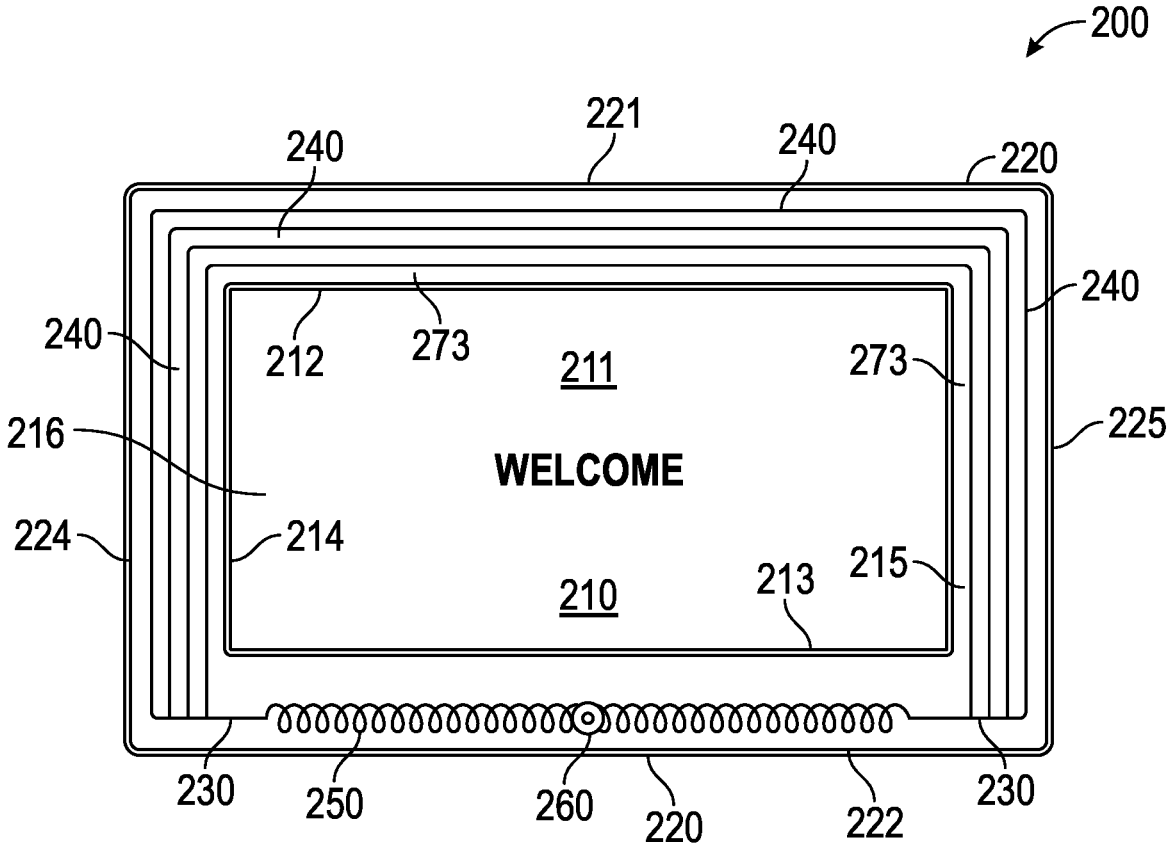
FIG. 5 shows a top view of an improved doormat in accordance with a second illustrated embodiment.

FIG. 5 shows a top view of an improved doormat (200) in a collapsed state in accordance with a second illustrated embodiment. The improved doormat comprises a center portion (210) coupled to an anchored frame (220). The center portion has a first major edge (212), a second major edge (213), a first minor edge (214), and a second minor edge (215). A collapsible storage apparatus (240) is shown collapsed and disposed between the center portion and the anchored frame. The collapsible storage apparatus comprises a terminal end (273) and a canopy frame (270) coupled to the anchored frame. The canopy frame comprises a plurality of ribs (271) and a canopy (272). The terminal end is rotatably coupled to the anchored frame by a hinge (230) or other mechanism known to cause a rotational movement. The canopy is coupled to both the terminal end and the anchored frame. An actuator (260) is coupled to the anchored frame such that, when the actuator is engaged, the canopy frame releases from a collapsed state and automatically deploys via a spring (250) disposed within the anchored frame and coupled to the terminal end. When the improved doormat is in the collapsed state, the center portion sits completely or nearly flush with the anchored frame. Total height during the collapsed state may be approximately 1". Other heights may also be achieved depending on final design.

The anchored frame (220) comprises a first major side (221), a second major side (222), a first minor side (223), and a second minor side (224). As shown, the terminal end (273) is rotatably coupled to the anchored frame at the second major side wherein the canopy frame (270) is coupled to the anchored frame at the first major side, the first minor side, and the second minor side. As the terminal end rotates about the second major side towards a ground surface adjacent to the second major side, the canopy frame deploys until the terminal end makes contact the ground surface. Generally, the canopy frame is characterized as being in a semi-circle formation when in full deployment. In other embodiments, the terminal end is rotatably coupled to one of the other sides of the anchored frame. For example, the terminal end may be rotatably coupled to the first minor side and the canopy frame is coupled to the anchored frame at the first major side, the second major side, and the second minor side.

The center portion (210) includes an upper surface (216) and a lower surface opposite the upper surface. The upper surface may include a doormat material (211) configured to perform functions of a doormat include drying and/or cleaning feet before entering a household. In some embodiments, the center portion is fixedly coupled to the anchored frame (220) at the lower surface. In other embodiments, the center portion is configured to be interchangeable, thereby allowing a user to switch doormat materials and designs as desired.

As shown, the collapsible storage apparatus (240) is shown in a collapsed state with the ribs (271) nested within each other. In alternative embodiments, the ribs may stack on top of one another. The terminal end (273) is disposed between the ribs and the center portion and a portion of the canopy disposed outside an outermost rib is coupled at or near the sides of the anchored frame (220).

In some embodiments, sensors are utilized instead of or in combination with the actuator (260) for means of deploying the collapsible storage apparatus (240). Such sensors may include IR, proximity, pressure, or any other kind that can be appreciated by one having skill in the art for detecting a presence of one or more packages.

Figure 6:
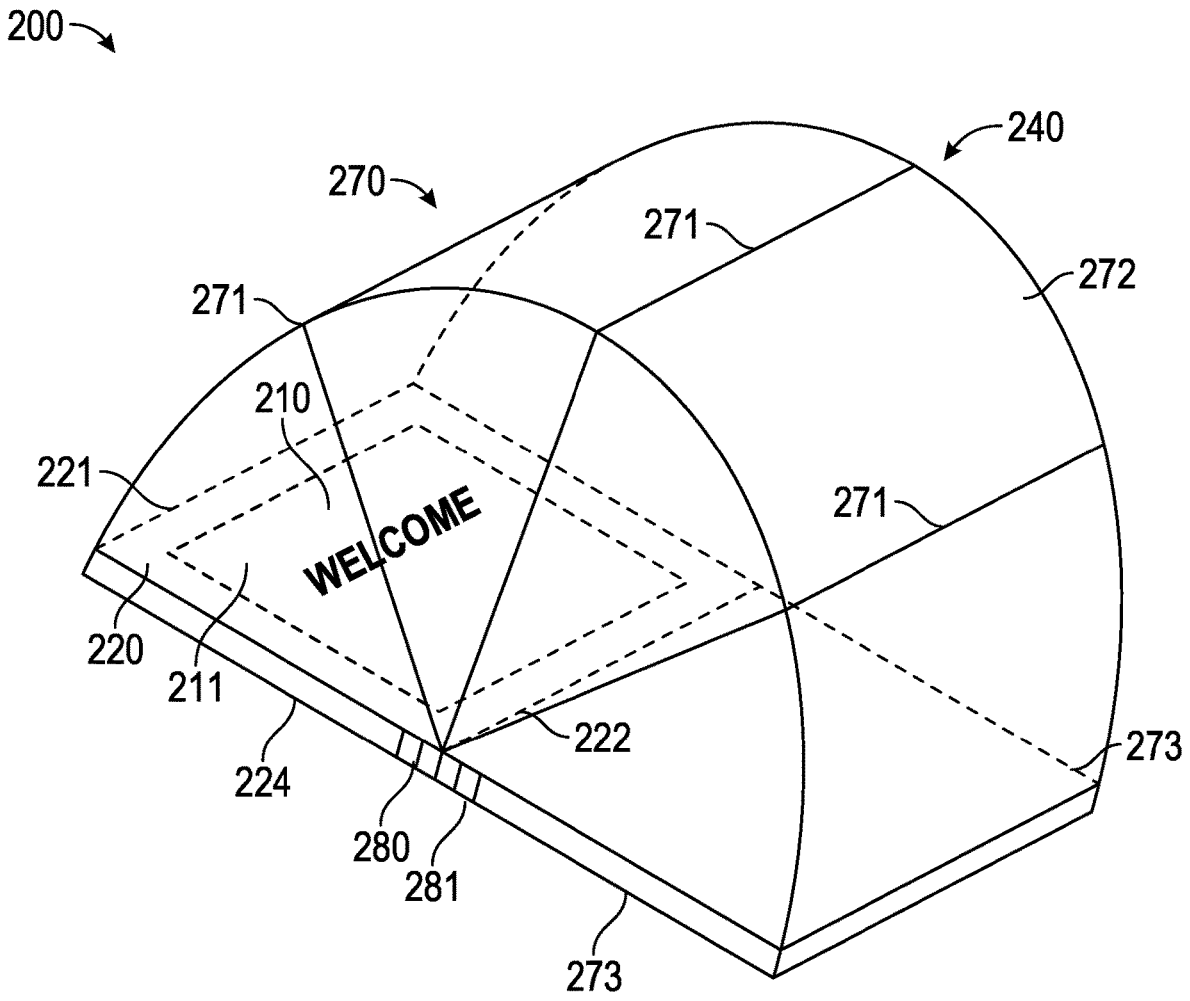
FIG. 6 shows a perspective view of the improved doormat in accordance with the second illustrated embodiment.

FIG. 6 shows a perspective view of the improved doormat (200) in an expanded state in accordance with the second illustrated embodiment. The improved doormat comprises a collapsible storage apparatus (240) having a canopy frame (270) and a terminal end (273) hingedly coupled to an anchored frame (220). Disposed within the anchored frame is a center portion (210) comprising a doormat material (211). The center portion is shown fully covered by the canopy frame. The canopy frame includes a canopy (272), and one or more ribs (271) to provide form and structure to the canopy frame. In other embodiments, material of the canopy may be sufficiently rigid that ribs are not necessary. The canopy frame is fully deployed when the terminal end has fully rotated and reached a ground surface beyond the improved doormat. Once the terminal end has reached the ground surface, a locking mechanism (281) prevents the canopy frame from collapsing. The locking mechanism may be integrated such that once the canopy frame has reached an angle of approximately 180 degrees, the locking mechanism is automatically engaged, thereby preventing the terminal end of any rotational movement until the locking mechanism has been disengaged. The anchored frame is affixed to the ground surface and the canopy frame is in a locked position relative to the anchored frame. Packages contained within the expanded collapsible storage apparatus are not accessible by a user until the canopy frame is unlocked.

Generally, one or more packages are placed on top of or immediately in front of the center portion (210) while the collapsible storage apparatus (240) is in a collapsed state. Once the packages are in a proper position, the collapsible storage apparatus is deployed and the terminal end (272) and canopy frame (270) rotate away from the anchored frame (220) and unfolds as the terminal end rotates towards the ground surface in front of the doormat.

In some embodiments, the collapsible storage apparatus (240) is manually deployed by a user pulling and rotating the terminal end (273) until the canopy frame (270) reaches a locked position. In other embodiments, an actuator (260; FIG. 5) is used to perform an automatic deployment of the canopy frame. Means of performing the deployment automatically include springs, hydraulics, motors, or any other mechanism which can be appreciated by one having skill in the art.

In some embodiments, the anchored frame (220) couples to the ground surface by use of adhesive, glue, fasteners, or any other means of coupling that can be appreciated by one having skill in the art. In other embodiments, the anchored frame couples to the ground surface by a weight that makes moving and transporting the improved doormat (200) prohibitively difficult.

In some embodiments, the anchored frame (220) entirely surrounds the center portion (210). In other embodiment, the anchored frame surrounds the center portion at three of four sides of the center portion, preferably the first major edge (212), the first minor side (214), and the second minor side (215), thereby leaving the second major edge (213) exposed. Said embodiments can be characterized as the anchored frame having a right-angled horseshoe or a C-shaped configuration. The exposed edge can be located at a front of the center portion facing away from a house, thereby creating no obstructions when a person walks up and onto the center portion. This embodiment is preferable for thinner doormats and provides ease of sweeping the improved doormat.

Figure 7:
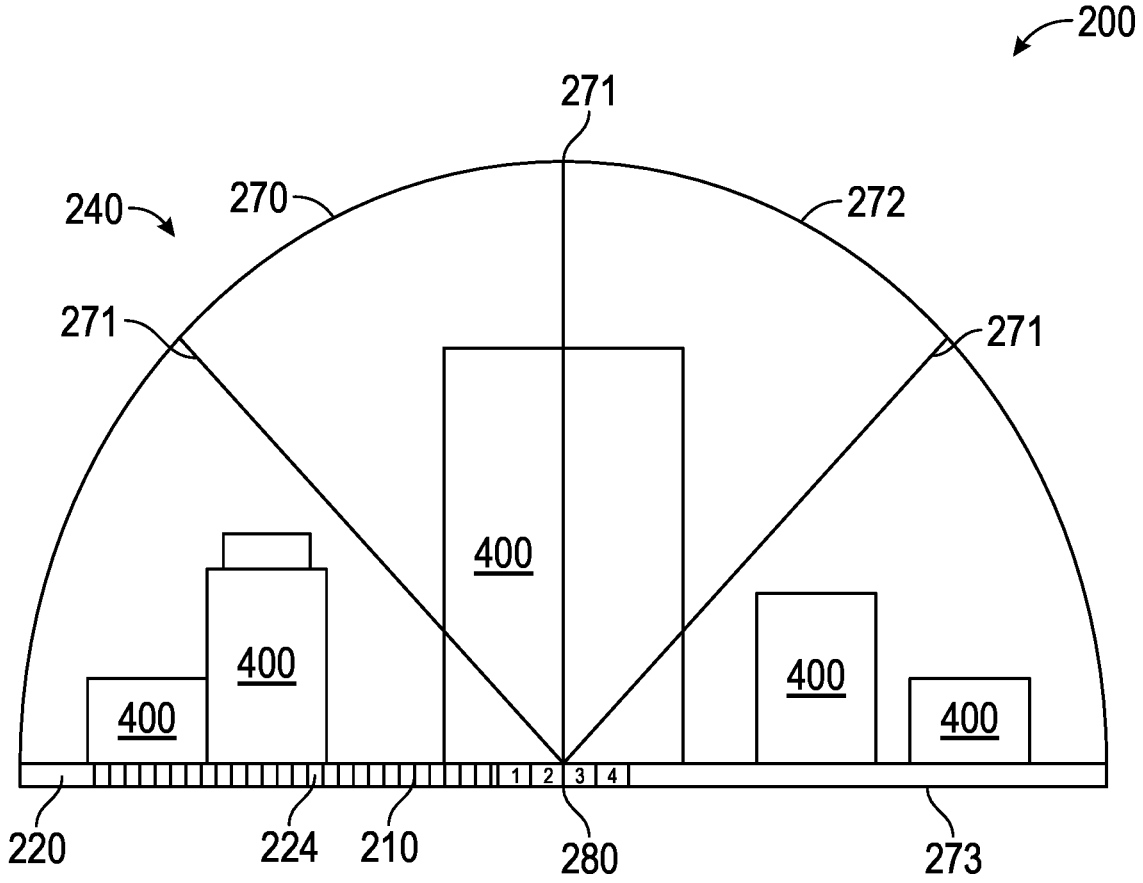
FIG. 7 shows a side view of the improved doormat in accordance with the second illustrated embodiment.

FIG. 7 shows a side view of the improved doormat (200) in an expanded state in accordance with the second illustrated embodiment. The improved includes a center portion (210) disposed within an anchored frame (220). A collapsible storage apparatus (240) is coupled to the anchored frame and is in a fully expanded and locked position. The collapsible storage apparatus comprises a canopy frame (270) having a canopy (272) and ribs (271). Encapsulated within the canopy frame are packages (400), said packages only accessible by unlocking the canopy frame and retracting a terminal end (273). An access point (280) is disposed at a bottom portion of the canopy frame near the anchored frame, the access point configured to receive a code for unlocking the collapsible storage apparatus.

The canopy (272) is shown being translucent for illustrative purposes and in a preferable embodiment is opaque to prevent a thief from observing packages contained within the collapsible storage apparatus (240).

Third Illustrated Embodiment

Figure 8:
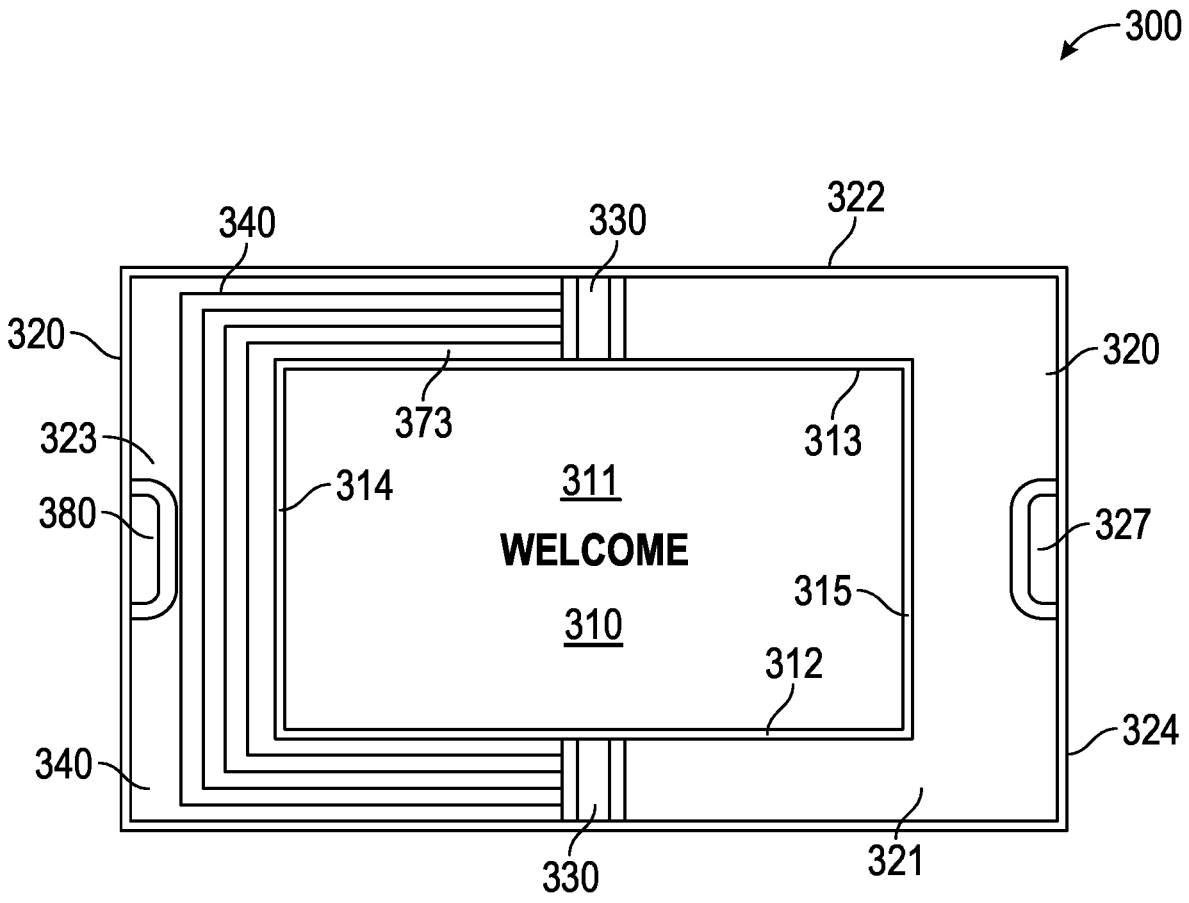
FIG. 8 shows a side view of an improved doormat in accordance with a third illustrated embodiment.
Figure 9:
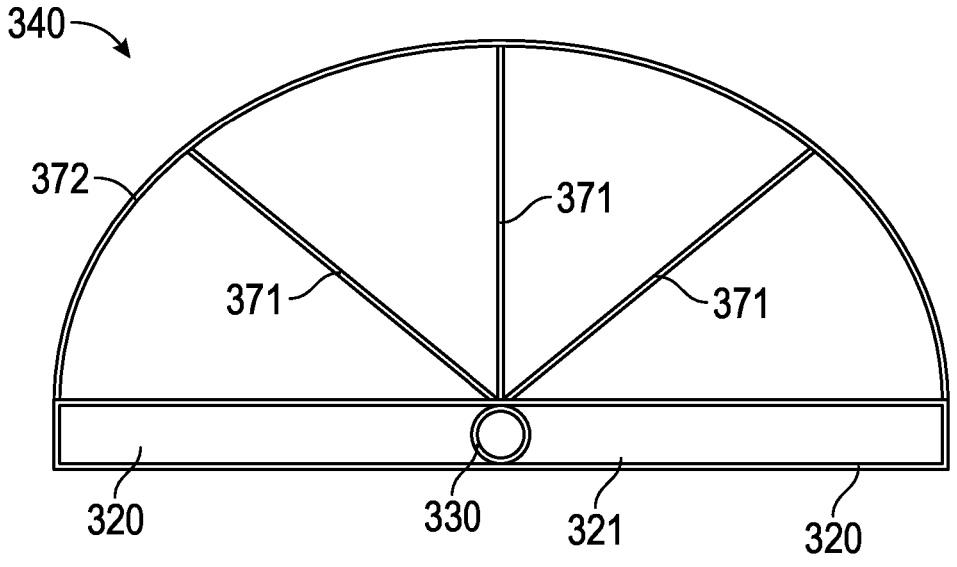
FIG. 9 shows a top view of the improved doormat in accordance with the third illustrated embodiment.

FIG. 8 and FIG. 9 show, respectively, a top view and a side view of the improved doormat (300) according to third second illustrated embodiment. FIG. 8 shows the improved doormat in a collapsed state, and FIG. 9 shows the improved doormat in an expanded state. The improved doormat comprises an anchored frame (320) having a center portion (310) disposed therewith, the center portion comprising a doormat material (311). The anchored frame comprises a first major side (321), a second major side (322) opposite the first major side, a first minor side (323), and a second minor side (324) opposite the first minor side forming a plurality of sides of the anchored frame. The center portion includes a first major edge (312), a second major edge (313), a first minor edge (314), and a second minor edge (315). Disposed between the plurality of sides of the anchored frame and the center portion is a periphery configured to hold a collapsible storage apparatus (340). Specifically, the collapsible storage apparatus is configured to occupy half of the periphery while in a collapsed state. The collapsible storage apparatus comprises a terminal end (373), a canopy (372), and ribs (371) nested within the periphery of the first minor side, half of the first major side, and half of the second major side. The terminal end is rotatably coupled to the anchored frame at both the first major side and the second a major side. The terminal end is configured to rotate and rest within the unoccupied periphery of the second minor side, remaining half of the first major side, and the remaining half of the second major side. As the terminal end rotates, the canopy and ribs are subsequently pulled and unfolded.

The collapsible storage apparatus (340) may further comprise a handle (380) for ease of pulling the terminal end (373) into an expanded state. The anchored fame comprises a latch (327) disposed on the second minor side, the latch being configured to couple with the collapsible storage apparatus while in the expanded state. A plurality of hinges (330) is disposed at the first major side (321) and the second major side (322) to provide means of rotation for the terminal end.

FEATURE LIST improved doormat (100; 200; 300)
center portion (110; 210; 310)
doormat material (111; 211; 311)
first major edge (112; 212; 312)
second major edge (113; 213; 313)
first minor edge (114; 214; 314)
second minor edge (115; 215; 315)
upper surface (116; 216; 316)
lower surface (117)
coupler element (118)
anchored frame (120; 220; 320)
first major side (121; 221; 321)
second major side (122; 222; 322)
first minor side (123; 223; 323)
second minor side (124; 224; 324)
anchor point (125)
bottom portion (126)
latch (127; 327)
hinge (130; 230; 330)
collapsible storage apparatus (140; 240; 340)
first collapsible side (141)
first side hinge (142)
second collapsible side (143)
second side hinge (144)
front portion (145)
lid (146)
spring (150; 250; 350)
actuator (260)
canopy frame (270)
rib (271; 371)
canopy (272; 372)
terminal end (273; 373)
access point (280)
locking mechanism (281)
handle (380)
package (400)

What is claimed is:

1. An improved doormat, comprising
an anchored frame anchored to a ground surface,
the anchored frame comprising a plurality of sides and a latch disposed on at least one of the plurality of sides;
a center portion disposed within the anchored frame, the center portion having an upper surface and a lower surface opposite the upper surface, the center portion further comprising a coupler element configured to couple to the latch when the improved doormat is in a collapsed state; and
a collapsible storage apparatus rotatably coupled to the anchored frame, the collapsible storage apparatus being disposed between the anchored frame and the center portion, the collapsible storage apparatus comprising:
the center portion rotatably coupled to the anchored frame,
a front portion opposite the center portion,
a first collapsible side coupled to the lower surface of the center portion and further coupled to the front portion,
a second collapsible side coupled to the lower surface of the center portion and further coupled to the front portion, and
a lid rotatably coupled to the front portion;
wherein the upper surface of the center portion comprises a doormat material.

2. The improved doormat of claim 1, further comprising a plurality of gas springs, wherein each of the plurality of gas springs is coupled to the anchored frame and further coupled to the lower surface of the center portion.

3. An improved doormat, comprising
an anchored frame anchored to a ground surface,
the anchored frame comprising a plurality of sides and a latch;
a center portion disposed within the anchored frame, the center portion having an upper surface and a lower surface opposite the upper surface; and
a collapsible storage apparatus rotatably coupled to the anchored frame,
the collapsible storage apparatus being disposed between the anchored frame and the center portion.

4. The improved doormat of claim 3, wherein the upper surface comprises a doormat material.

5. The improved doormat of claim 3, further comprising a plurality of gas springs, wherein each of the plurality of gas springs is coupled to the anchored frame and further coupled to the lower surface of the center portion.

6. The improved doormat of claim 3, the center portion further comprising a coupler element configured to couple to the latch when the improved doormat is in a collapsed state.

7. The improved doormat of claim 3, wherein the collapsible storage apparatus comprises:
the center portion rotatably coupled to the anchored frame;
a front portion opposite the center portion;
a first collapsible side coupled to the lower surface of the center portion and further coupled to the front portion;
a second collapsible side coupled to the lower surface of the center portion and further coupled to the front portion; and
a lid rotatably coupled to the front portion.

8. The improved doormat of claim 7, wherein the center portion comprises a coupler element and the lid comprises an aperture such that the coupler element is configured to be inserted through the aperture.

9. The improved doormat of claim 3, wherein the collapsible storage apparatus comprises:
a terminal end rotatably coupled to the anchored frame; and
a canopy frame coupled to the anchored frame and further coupled to the terminal end.

10. The improved doormat of claim 9, wherein the terminal end is rotatably coupled to the anchored frame at a first major side.

11. An improved doormat, comprising
an anchored frame anchored to a ground surface,
the anchored frame comprising a plurality of sides and a latch;

a center portion disposed within the anchored frame, the center portion having an upper surface and a lower surface opposite the upper surface; and a collapsible storage apparatus rotatably coupled to the anchored frame;

wherein the upper surface of center portion comprises a doormat material.

12. The improved doormat of claim 11, wherein the collapsible storage apparatus is disposed between the anchored frame and the center portion.

13. The improved doormat of claim 11, further comprising a plurality of gas springs, wherein each of the plurality of gas springs is coupled to the anchored frame and further coupled to the lower surface of the center portion.

14. The improved doormat of claim 11, the center portion further comprising a coupler element configured to couple to the latch when the improved doormat is in a collapsed state.

15. The improved doormat of claim 11, wherein the collapsible storage apparatus comprises:

the center portion rotatably coupled to the anchored frame;

a front portion opposite the center portion;

a first collapsible side coupled to the lower surface of the center portion and further coupled to the front portion;

a second collapsible side coupled to the lower surface of the center portion and further coupled to the front portion; and a lid rotatably coupled to the front portion.

16. The improved doormat of claim 15, wherein the center portion comprises a coupler element and the lid comprises an aperture such that the coupler element is configured to be inserted through the aperture.

17. The improved doormat of claim 11, wherein the collapsible storage apparatus comprises:

a terminal end rotatably coupled to the anchored frame; and a canopy frame coupled to the anchored frame and further coupled to the terminal end.

18. The improved doormat of claim 17, wherein the terminal end is rotatably coupled to the anchored frame at a first major side.

* * * * *